US005729845A

United States Patent [19]

Hsu

[11] Patent Number: 5,729,845

[45] Date of Patent: Mar. 24, 1998

[54] HAMMOCK STRUCTURE

[76] Inventor: Ke-Hsin Hsu, No.55-1, Ting-Hsing Rd., Ting-Hsing Tsun, Shen-Kang Hsiang, Changhua Hsien, Taiwan

[21] Appl. No.: 814,907

[22] Filed: Mar. 12, 1997

[51] Int. Cl.[6] ..... A45F 3/22

[52] U.S. Cl. ..... 5/120; 5/122; 5/127

[58] Field of Search ..... 5/120, 122, 123, 5/127, 129

[56] References Cited

U.S. PATENT DOCUMENTS

| | | | |
|---|---|---|---|
| 2,104,417 | 1/1938 | Tischler | 5/129 |
| 2,450,689 | 10/1948 | Richmond | 5/129 |
| 2,569,591 | 10/1951 | Anderegg | 5/122 X |
| 3,321,780 | 5/1967 | Morris | 5/123 X |

FOREIGN PATENT DOCUMENTS

| | | |
|---|---|---|
| 1958083 | 1/1969 | Germany . |
| 421191 | 12/1931 | United Kingdom . |

*Primary Examiner*—Michael F. Trettel
*Attorney, Agent, or Firm*—Bacon & Thomas

[57] ABSTRACT

A hammock structure comprising an assembled frame and a detachable hammock. The frame includes two horizontal tubes for support on the ground, four L-shaped connecting tubes fitted respectively with two ends of each horizontal tube, four extension tubes fitted with the connecting tubes, two U-shaped tubes fitted with the ends of the extension tubes and two reinforcing chains connected between each two connecting tubes. The hammock includes two rod members each of which is formed with several through holes. A fastening hook is screwed into one end of each through hole to engage with a securing ring. A main cord at one end of the hammock is hung on the fastening hook, while a hanging cord is tied with each securing ring. Each hanging cord is further hung on a ring member to permit detachable engagement of the hammock on the frame.

5 Claims, 7 Drawing Sheets

HAMMOCK STRUCTURE

BACKGROUND OF THE INVENTION

The present invention relates to a hammock structure including an assembled frame and a hammock which is easily and detachably hung on the frame.

FIG. 1 shows a conventional hammock structure 1 including a hammock 12 and a frame 11. The hammock 12 includes two rod members 121 each of which is formed with several through holes 122 for passing the cords 13 at two ends of the hammock 12 therethrough. The free ends of the cords 13 are collected into a bundle to be fitted into a ring member 131 for hanging the hammock 12 on the hanging hooks 111 of the frame 11. Some disadvantages exist in this arrangement as follows:

1. The frame 11 is of a fixed type and cannot be folded, collapsed or disassembled when not used, so it is difficult to store the frame 11 and requires a large storage space.

2. The respective cords 13 of the hammock 12 are passed through the through holes 122 of the rod members 121 so that it is difficult to wash the hammock 12.

3. The hanging hooks 111 are welded on the frame 11 and cannot be detached therefrom. When bearing heavy weight, the hanging hooks 111 are subject to breakage. When this takes place, the entire frame 11 must be replaced. This is not economical.

SUMMARY OF THE INVENTION

It is therefore a primary object of the present invention to provide a hammock structure which can be easily assembled, disassembled and washed.

The present invention can be best understood through the following description and accompanying drawings.

DETAILED DESCRIPTION OF THE PREFERRED EMBODIMENTS

Please refer to FIGS. 2 to 5. The present invention includes an assembled frame 2 and a hammock bed 3.

Figures 1, 1A:
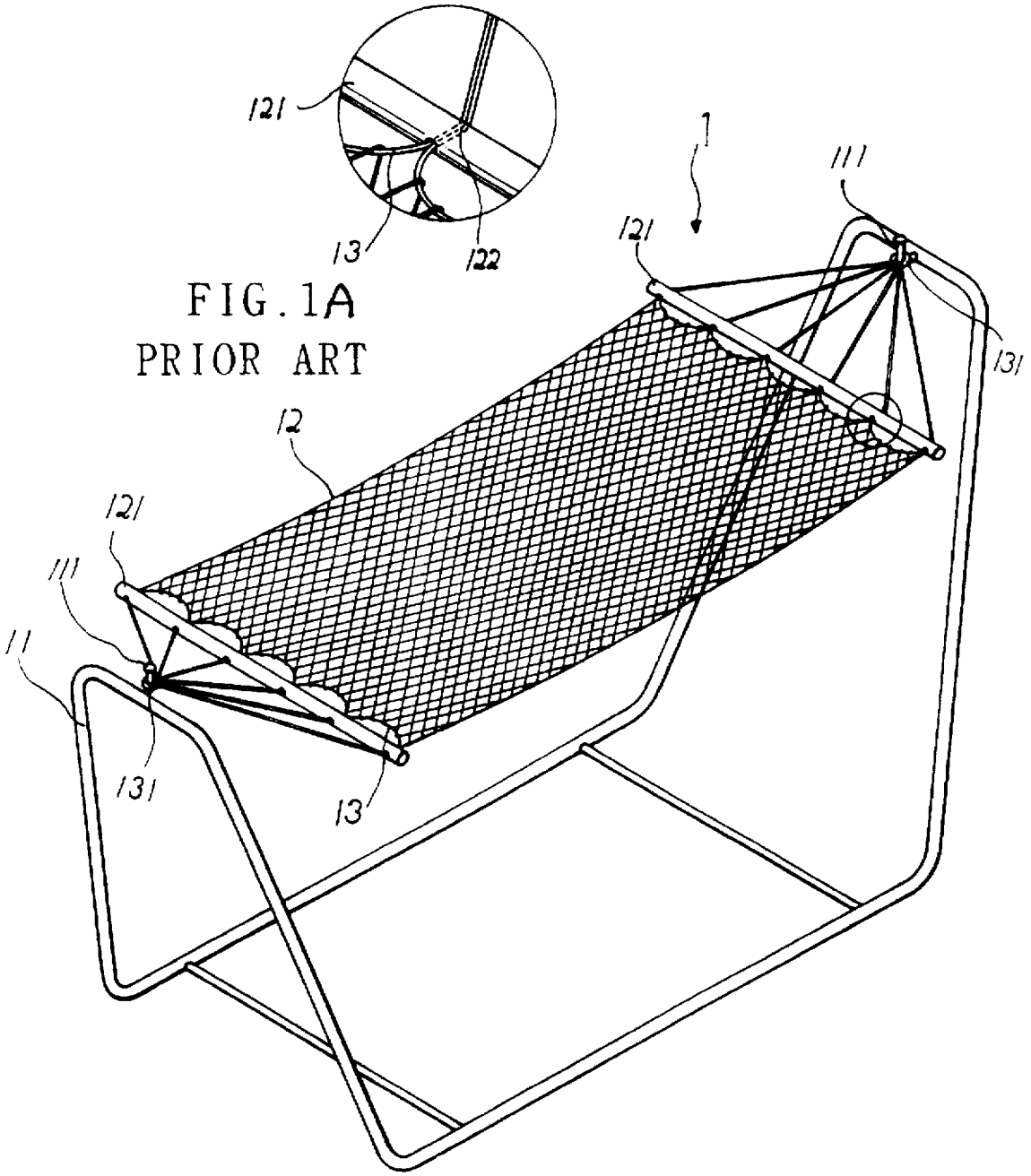
FIG. 1A PRIOR ART
FIG. 1 PRIOR ART
FIG. 1 is a perspective view of a conventional hammock structure.
FIG. 1A is a partially enlarged diagram of a portion of FIG. 1.
Figure 2:
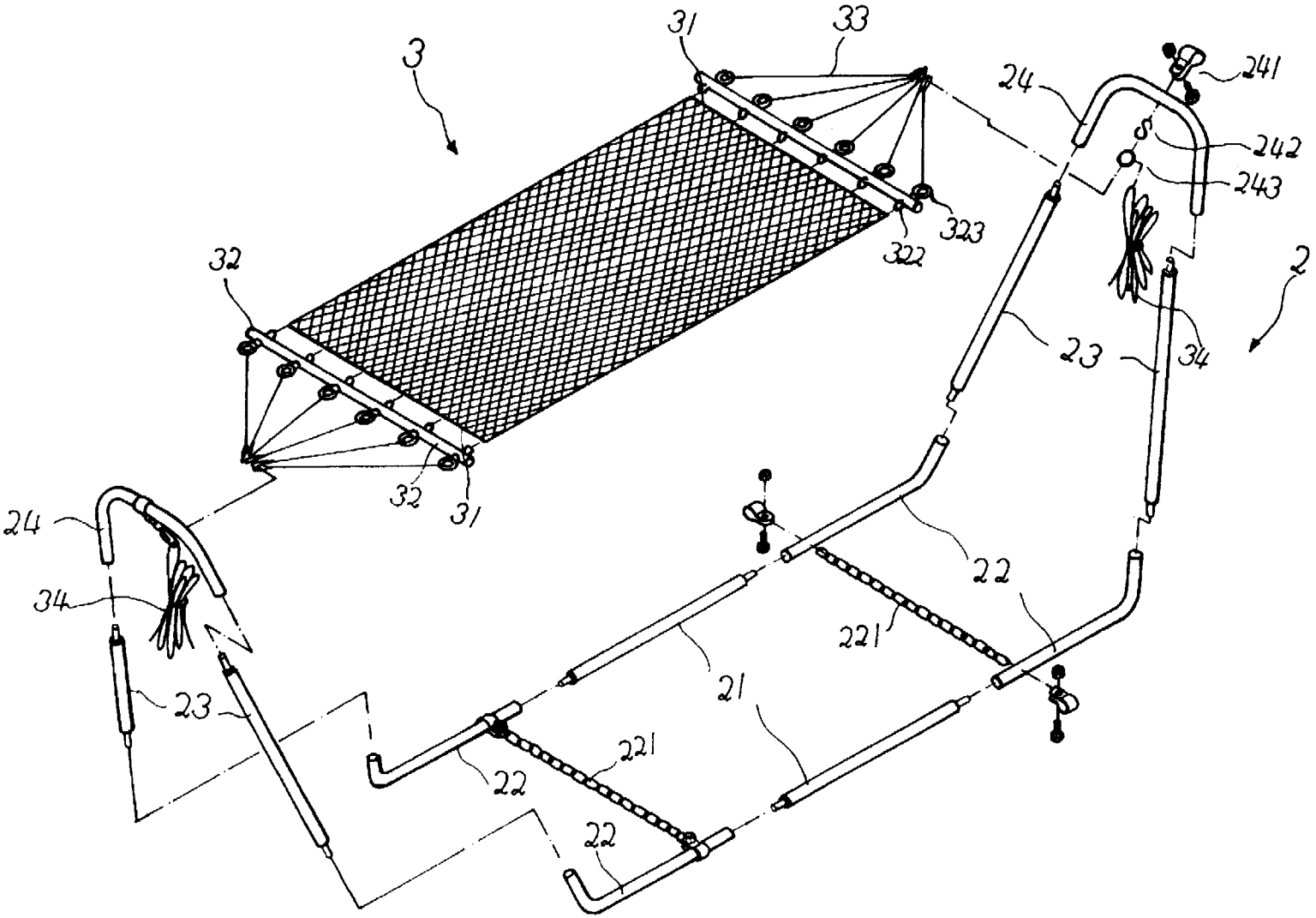
FIG. 2 is a perspective exploded view of the present invention.
Figure 3:
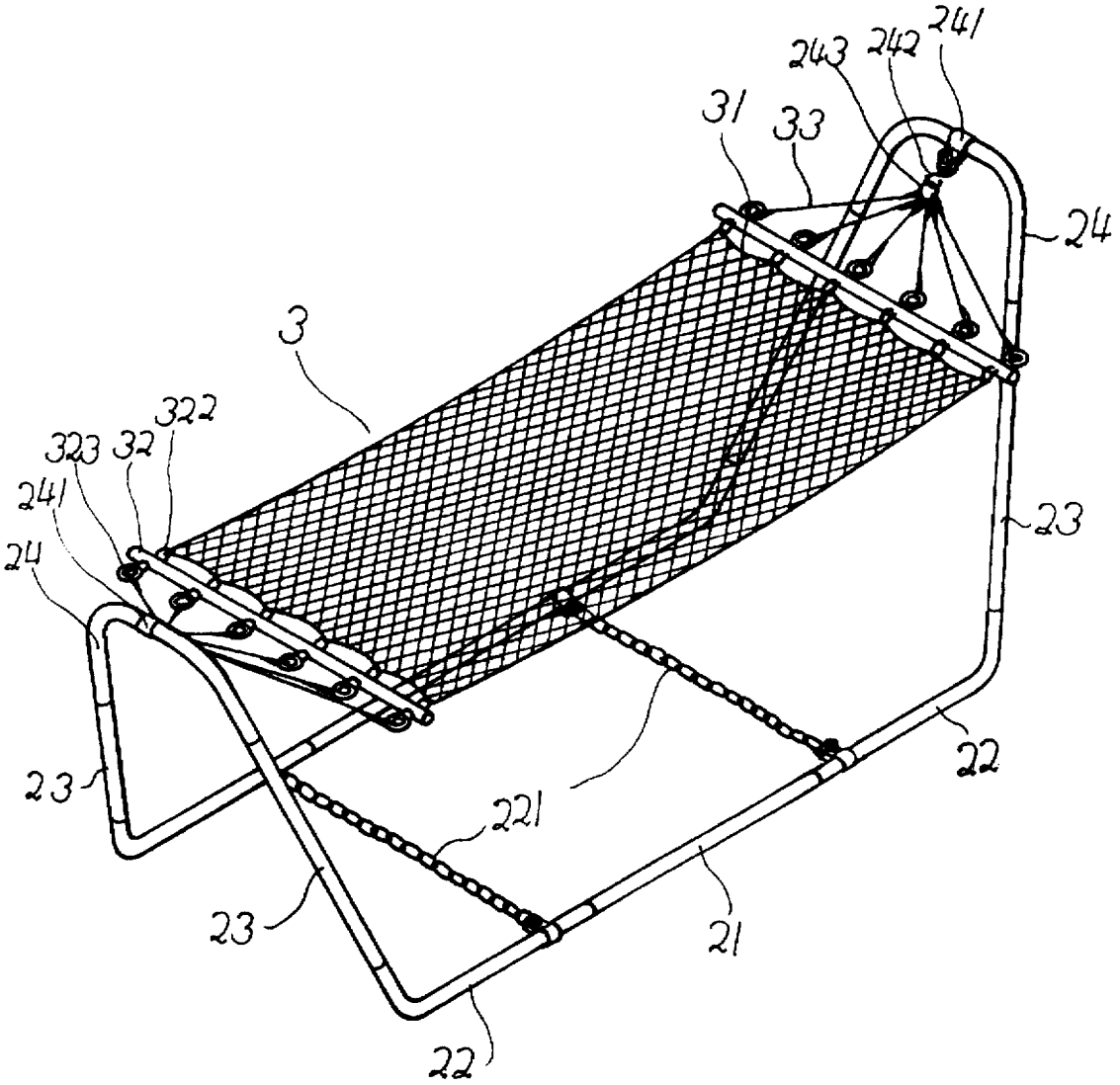
FIG. 3 is an enlarged view of a part of the present invention.
Figure 4:
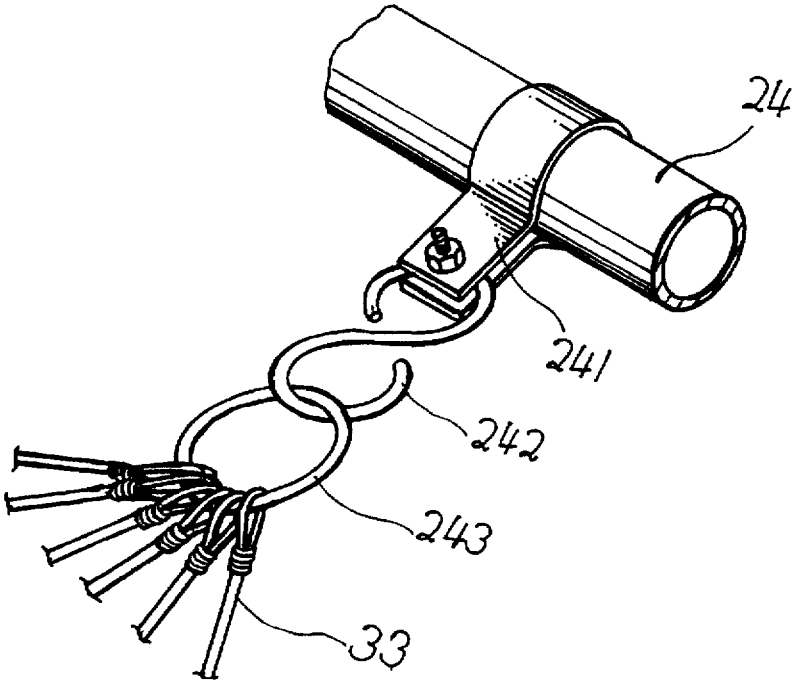
FIG. 4 is an enlarged view of another part of the present invention.

The frame 2 includes two horizontal tubes 21 for support on the ground. Two L-shaped connecting tubes 22 are fitted respectively with two ends of each horizontal tubes 21. The other end of each connecting tube 22 is fitted with an extension tube 23. A U-shaped tube 24 is fitted with the ends of each two extension tubes 23. In addition, a reinforcing chain 221 is connected between each two connecting tubes 22 to increase the stability of the frame 2. A locking plate 241 is disposed on each U-shaped tube 24. An S-shaped hanging hook 242 is fitted with the locking plate 241 and a ring member 243 is hung on the hanging hook 242 as shown in FIG. 2 and FIG. 4.

Figure 5:
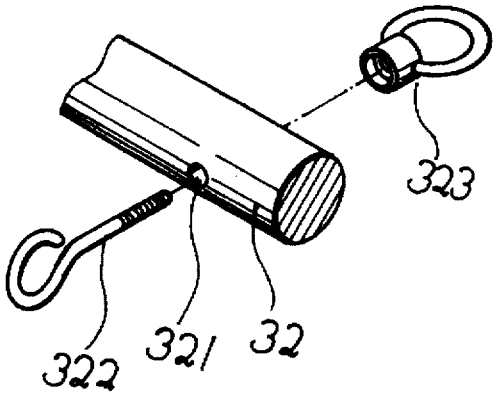
FIG. 5 is a perspective assembled view of the present invention.

The hammock bed 3 includes two rod members 32 each of which is formed with several through holes 321. A fastening hook 322 is screwed into one end of each through hole 321 to engage with a securing ring 323 as shown in FIG. 5. The main cord 31 at both ends of the hammock bed 3 are hung on the fastening hooks 322, and a hanging cord 33 is tied with securing ring 323. The hanging cords 33 are further hung on the ring members 243 of the frame 2 as shown in FIG. 4. A long cord 34 is disposed on each ring member 243.

According to the above arrangement, when it is desired to wash the hammock bed 3, the main cords 31 at two ends of the hammock bed 3 are detached from the fastening hooks 322. After the hammock bed 3 is cleaned and dried, the main cords 31 are then respectively hung on the fastening hooks 322.

Moreover, when not used, the components of the frame 2 can be disassembled without occupying much room. Also, the long cord 34 on the each ring member 243 can be tied on a branch of a tree when used outdoors.

The rod members 32 of the hammock bed 3 are provided with several through holes 321 for passing the fastening hooks 322 therethrough. The fastening hooks 322 can be alternatively screwed with a butterfly nut to reduce the number of the securing rings 323 so as to lower cost.

Figure 6:
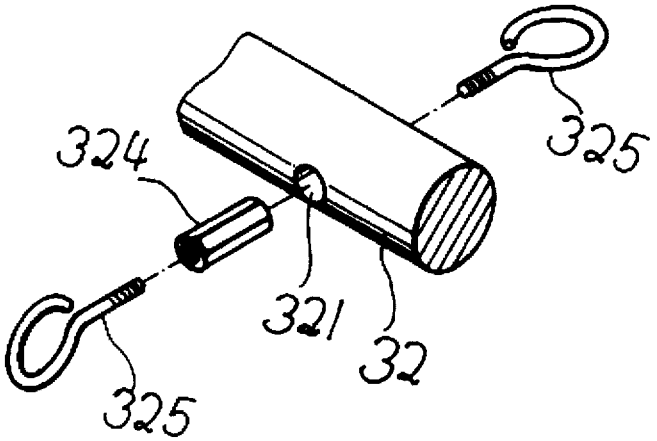
FIG. 6 shows another embodiment of the present invention.

Referring to FIG. 6, alternatively, an elongated nut 324 can be disposed in the through hole 321 of the rod member 32 for screwing with a pair of fastening hooks 325 to achieve equivalent effect.

Figure 7:
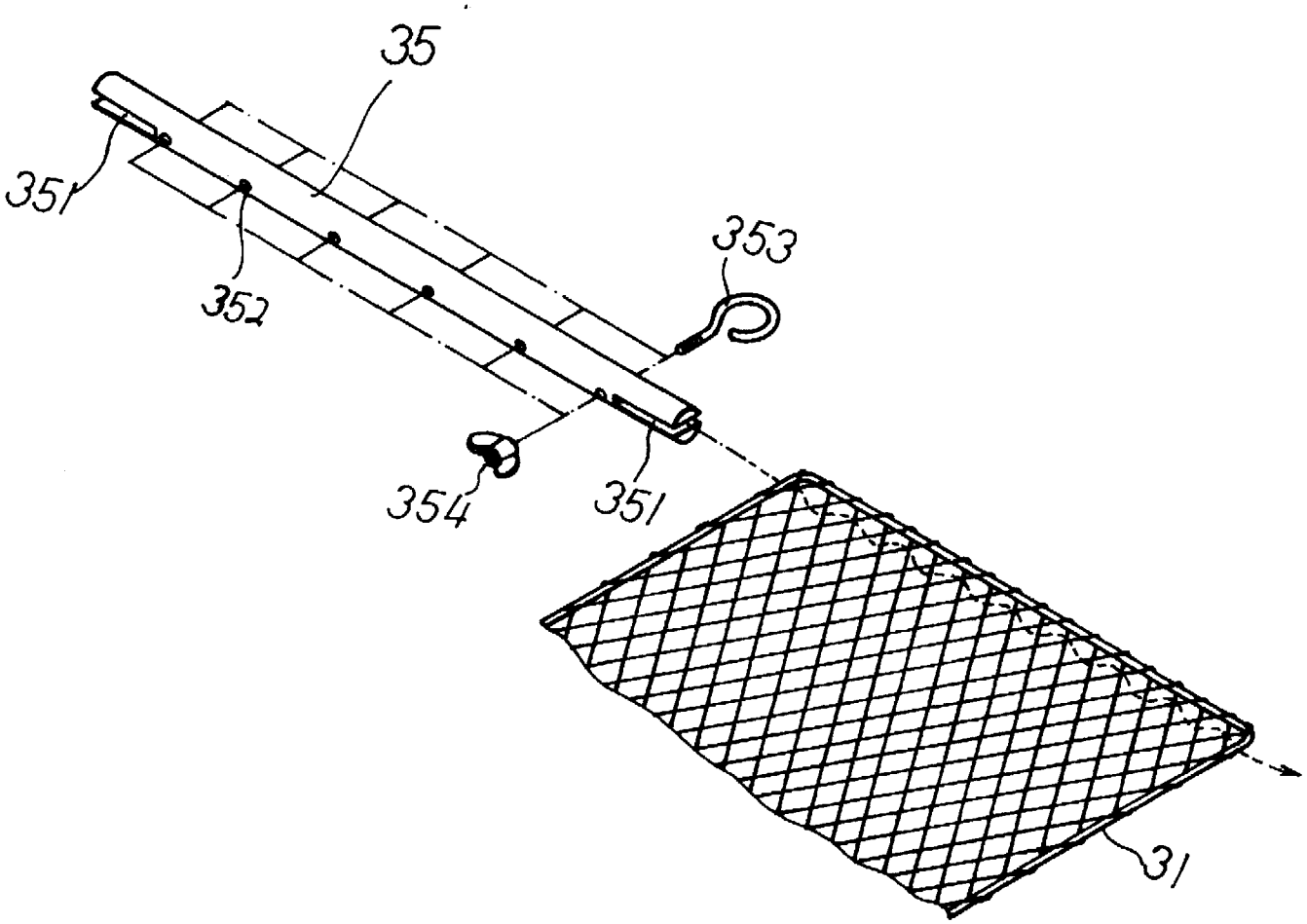
FIG. 7 is an exploded view of another embodiment of the present invention.
Figure 8:
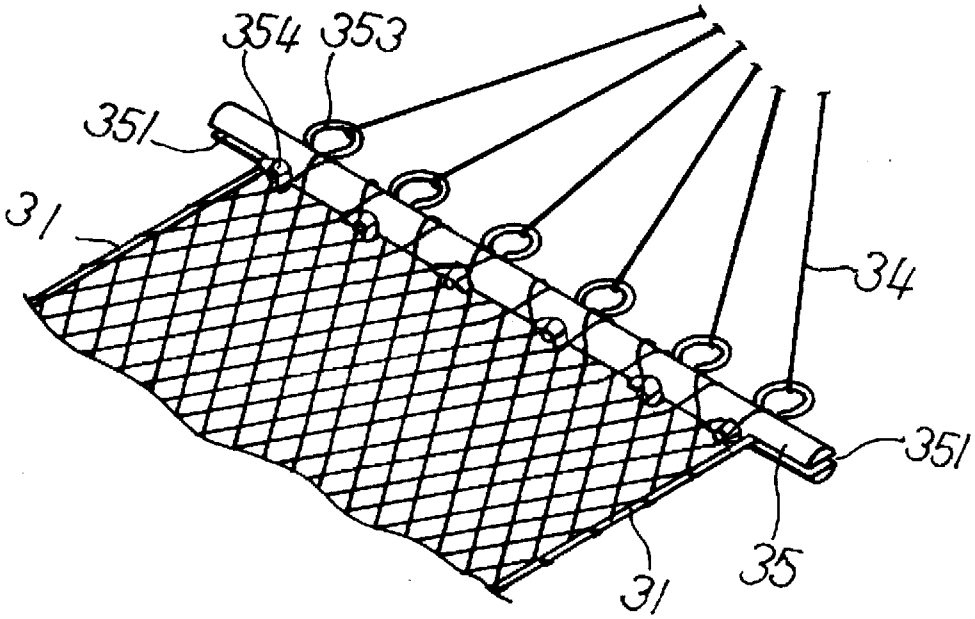
FIG. 8 is an assembled view of the embodiment of FIG. 7 of the present invention.

FIGS. 7 and 8 show another embodiment of the present invention, in which each end of the rod member 35 is formed with a cut 351 and sequentially conducted through the meshes of one end of the hammock bed 3. Also, the main cords 31 are bridged in the cuts 351 of the rod members 35, whereby two ends of the hammock bed 3 are retained by the rod members 35 so as to stretch the hammock bed 3. The rod member 35 is formed with several through holes 352, whereby a butterfly nut 354 can secure a fastening hook 353 on one side of the rod member 35 for hanging the hanging cord 33 thereon. Accordingly, the hammock bed 3 can be easily detached from the frame 2.

The above embodiments are only some examples of the present invention and the scope of the present invention should not be limited to the examples. Any modification or variation derived from the examples should fall within the scope of the present invention.

What is claimed is:

1. A hammock structure comprising:

a) a frame formed from a plurality of tubes detachably secured together, which tubes include a pair of horizontal tubes for engaging a support surface, two pairs of L-shaped tubes secured to the horizontal tubes, a pair of extension tubes secured to each pair of L-shaped tubes, and a U-shaped tube secured to each pair of extension tubes;

b) a reinforcing chain connected between each pair of L-shaped tubes, a locking plate mounted on each U-shaped tube, an S-shaped hook secured to each locking plate, and a ring member secured to each S-shaped hook;

c) a hammock bed including a pair of ends, a main cord extending through each end of the hammock bed; and d) a pair of rod members, each rod member having a plurality of spaced holes formed therethrough, a threaded fastener assembly disposed through each hole, each main cord being secured to the fastener assemblies of a rod member, and a hanging cord connecting each fastener assembly to the ring member of the frame.

2. The hammock structure of claim 1 wherein each fastener assembly includes a threaded fastening hook secured to the main cord and a threaded securing ring connected to the hanging cord.

3. The hammock structure of claim 1 wherein each fastener assembly includes a threaded fastening hook secured to the main cord and a butterfly nut secured to each of some of the fastening hooks and a threaded securing ring secured to each of the remaining fastening hooks.

4. The hammock structure of claim 1 wherein each fastener assembly includes an elongate nut, a first threaded fastening hook and a second threaded fastening hook, the first threaded fastening hook being secured to the main cord and the second threaded fastening hook being connected to the hanging cord.

5. The hammock structure of claim 1 wherein each rod member includes a pair of cut ends, each main cord being engaged within the cut ends of each rod member, each fastener assembly including a wing nut and a threaded fastening hook, and each threaded fastening hook being connected to the hanging cord.

* * * * *